United States Patent [19]

Ryan

[11] 4,231,176

[45] Nov. 4, 1980

[54] VISIBLE INDEXES

[76] Inventor: Keith Ryan, 121 Parkside Way, Harrow, Middlesex, HA2 6DB, England

[21] Appl. No.: 914,866

[22] Filed: Jun. 12, 1978

[30] Foreign Application Priority Data

| | | | |
|---|---|---|---|
| Jun. 15, 1977 | [GB] | United Kingdom | 25063/77 |
| Nov. 11, 1977 | [GB] | United Kingdom | 47141/77 |
| Apr. 12, 1978 | [GB] | United Kingdom | 14334/787 |

[51] Int. Cl.[3] ..... G09F 7/22

[52] U.S. Cl. ..... 40/395; 40/535

[58] Field of Search ..... 40/395, 396, 397, 398, 40/401, 534, 535, 359, 360, 405

[56] References Cited

U.S. PATENT DOCUMENTS

| | | | |
|---|---|---|---|
| 1,483,215 | 2/1924 | Saussure | 40/394 |
| 1,586,529 | 6/1926 | Holmes | 40/395 |
| 1,598,257 | 8/1926 | Rand | 40/396 |
| 1,614,779 | 1/1927 | Dumont | 40/395 |
| 1,684,807 | 9/1928 | Ringler | 40/395 |
| 1,744,979 | 1/1930 | Matthes | 40/395 |
| 1,895,784 | 1/1933 | Chauvin | 40/397 |
| 3,159,931 | 12/1964 | Hopen | 40/395 |

FOREIGN PATENT DOCUMENTS

| | | | |
|---|---|---|---|
| 2531731 | 2/1977 | Fed. Rep. of Germany | 40/359 |
| 1532797 | 7/1968 | France | 40/359 |
| 365078 | 11/1938 | Italy | 40/396 |

*Primary Examiner*—John F. Pitrelli
*Assistant Examiner*—G. Lee Skillington
*Attorney, Agent, or Firm*—Brisebois & Kruger

[57] ABSTRACT

The invention relates to a visible index, and to a novel carrier for the records of a visible index, in which the records are hooked over retaining flanges which extend inwardly of the V-shaped channel portions of carriers which also comprise spacer portion which extend above the apices of the channel portions and locate respectively in the channel portion of the carrier directly thereabove, to provide an overlapping array of the records hooked on the carriers and also further to inhibit detachment of a record hooked on a retaining flange, as well as optionally also further records attached to the carriers, by the internesting of adjacent carriers.

6 Claims, 12 Drawing Figures

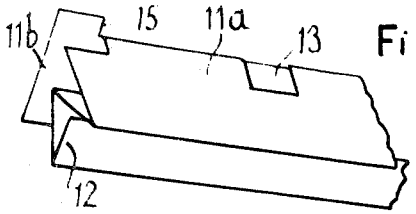
Fig.5
Fig.6
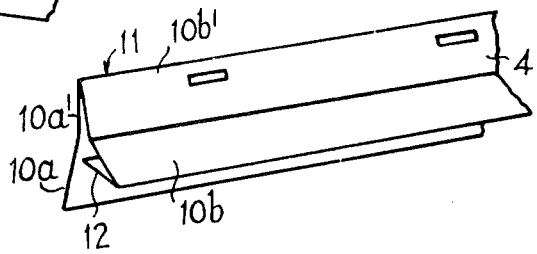
Fig.7
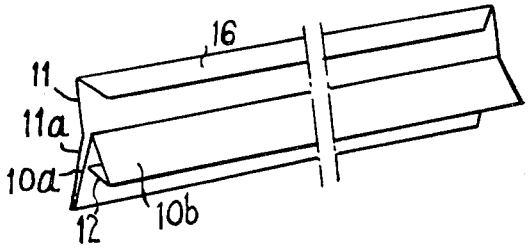
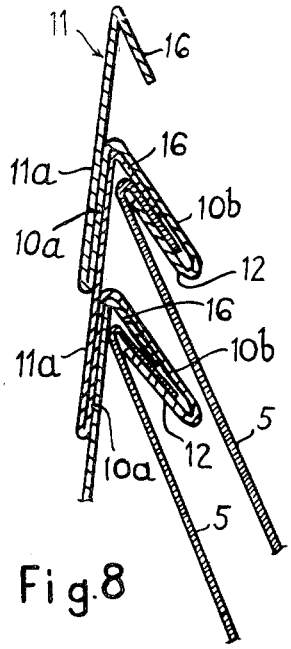
Fig.8
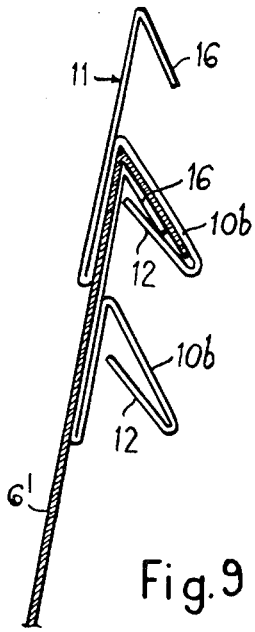
Fig.9

VISIBLE INDEXES

FIELD OF THE INVENTION

The invention relates to a visible index in which a plurality of papers, cards and the like for receiving information (for example by writing or typing thereon) or constituting information (such as microfilm and microfiches) (hereinafter collectively called "records") are attached to or supported by carriers adapted to be arranged one above the other so that the records are arranged in overlapping array to facilitate access to a particular record. The invention also relates to carriers for enabling such a visible index to be created.

BACKGROUND TO THE INVENTION

In such visible indexes, carriers often have to be assembled in panels or trays, and sometimes internested in each other with varying degrees of difficulty. Examples of prior systems are described in British Specifications Nos. 364,893; 365,467; 366,308; 452,786; 465,596; 559,965; 686,586; 715,705; 737,169 and 421,525; U.S. Pat. Nos. 1,480,419; 1,895,784; 1,329,536; 1,684,807; 1,594,113 and 1,500,718; and Swiss Pat. No. 179,469. Some systems hold the filed records securely but do not permit the records to be filed and removed quickly and easily. In other systems, where the records can be filed and removed more easily, they are not held securely when filed. Some of the systems cannot conveniently accommodate multi-page records and, in some, the reverse of even a one-page record cannot be inspected unless the record is removed from the carrier.

SUMMARY OF THE INVENTION

The present invention facilitates quick and easy filing and removal of records, as required, whilst holding filed records with a high degree of security and enabling both sides of filed records to be easily inspected without having to be removed from the carrier. It also enables multi-page records to be accommodated and in some embodiments functions without having to be assembled in a panel or tray.

It is usual to refer to the carriers as being arranged one above the other, even though they may be in a substantially horizontal plane. In this specification the term "above" is used in a similar way and means the direction substantially in the median plane of a carrier which is opposite to the direction in which a record normally depends from the carrier.

From one aspect, the invention comprises a visible index in which the records are detachably attached to carriers arranged one above the other so that the records are arranged in overlapping array, characterized in that each carrier comprises an elongate substantially V-shaped channel portion with a record retaining flange extending inwardly of the channel, and a spacer portion which projects beyond the apex of the channel portion and locates in the channel portion of the adjacent carrier directly thereabove, and records are attached to the carriers by being hooked over the retaining flanges thereof, whereby the carriers, when in said locating relationship, not only ensure the desired overlapping array of the records hooked thereon but also further inhibit detachment of a record hooked on to a retaining flange by pressing the record between the inner surface of the channel to which it is attached and the outer surface of the carrier therebeneath.

The invention also comprises a carrier for a record of a visible index in which the records are arranged in overlapping array, comprising an elongate substantially V-shaped channel portion with a record retaining flange extending inwardly of the channel, and a spacer portion which projects beyond the apex of the channel portion and is dimensioned to locate in the channel portion of an identical carrier and to ensure that adjacent carriers are spaced relative to one another to provide a desired overlapping relationship.

BRIEF DESCRIPTION OF THE DRAWINGS

In order that the invention may be more clearly understood, reference will now be made to the accompanying drawings, in which:

FIG. 5 shows a fragmentary view of a modification of the carrier shown in FIG. 2, FIGS. 6 and 7 show alternative forms of carrier, FIGS. 8 and 9 show modes of assembling the carrier of FIG. 7.

DETAILED DESCRIPTION OF THE INVENTION

Figure 1:
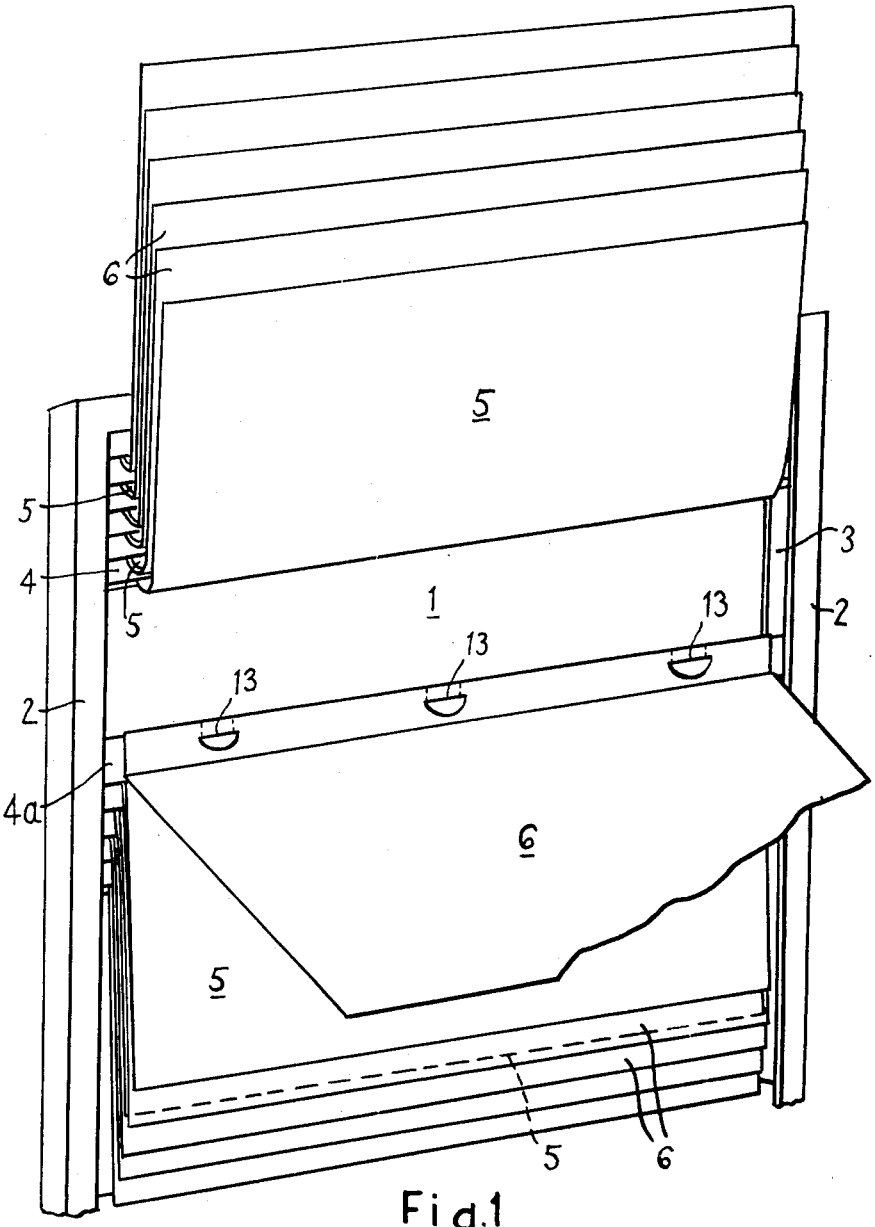
FIG. 1 is a perspective view of a part of a panel with carriers fitted thereto for providing a visible index according to this invention.

Referring to the drawings, the visible index shown in FIG. 1 comprises a panel 1 having inwardly facing channel members 2 around at least part of its periphery defining side channels 3 in which the opposite ends of carriers 4 can slide. The carriers have records 5,6 attached thereto in a manner to be explained with reference to FIGS. 2 and 3.

Figure 3:
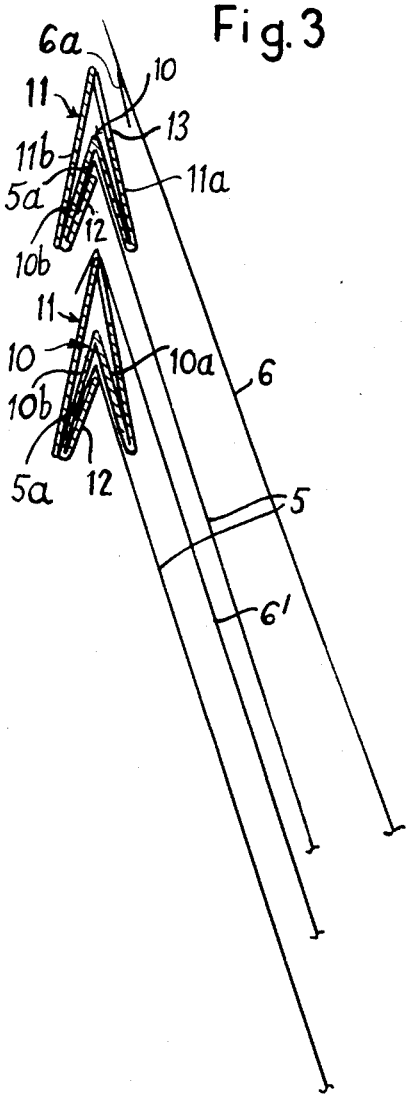
FIG. 3 is a side section of two carriers of FIG. 2 showing how records may be assembled to the carriers.

The carriers may be made of paper, card, plastic or other suitable material which is folded in the manner shown in FIG. 3 to form an elongate V-shaped channel portion 10 having sidewalls 10*a*, 10*b* and outside which is another V-shaped spacer portion 11 having side walls 11*a*, 11*b* which extend above the apex of the channel portion 10. The edge of the wall 10*b* of the channel portion 10 is folded to form a record retaining flange 12 extending inwardly of the channel. The walls 10*b* and 11*b* may be stuck together.

The record retaining flange 12 is adapted to receive the folded over edge 5*a* of a record 5, the edge 5*a* being hooked over the flange to extend into the space between the flange 12 and the wall 10*b* as shown in FIG. 3. The carrier 4 is also provided with openings 13 in the wall 11*a* of the spacer portion to detachably receive a record 6. The openings 13 are cut out of the wall 11*a* adjacent the apex of the spacer portion 11 so as to receive tongues 6*a* stamped out of the record 6 adjacent its upper edge. There may, for example, be three holes 13 spaced across a carrier with a corresponding number of tongues across the top of a record 6. The record 6 is attached to a carrier to overlie the exterior surface of the spacer portion by inserting the tongues 6*a* into the openings 13 as indicated in FIGS. 1 and 3.

Figure 4:
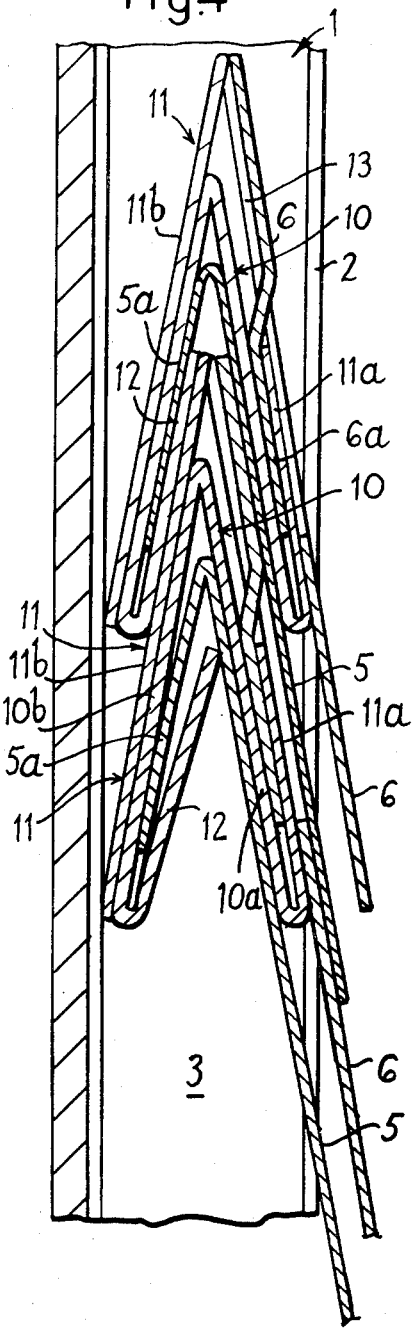
FIG. 4 is a side section through the panel of FIG. 1 and showing two carriers, with their records, disposed one above the other in the panel.

The carriers can be assembled in or removed from the panel 1 by slightly bowing them from end-to-end so that the ends of the carrier can be inserted into and between the opposing side channels 3. The channels 3 are so dimensioned that, when so inserted, the V-shape of the carriers is more compressed as shown in FIG. 4. When the series of carriers assembled in the panel are pushed together, the apex of the spacer portion 11 of one carrier enters the channel portion 10 of the carrier thereabove until it is stopped in a position in which the records attached to the carriers are arranged in overlapping array as shown in FIGS. 1 and 4. Also, as more clearly shown in FIG. 4, the spacer portion of a carrier moves the flange 12 of the adjacent carrier thereabove towards the adjacent wall 10*b* and also presses the record between the inner surface of the channel to which it is attached and the outer surface of the carrier therebeneath, in each case further to inhibit removal of the record 5. The upper carrier also inhibits detachment of the record 6 from the lower carrier as will also be apparent from FIG. 4. The records 5 facilitate entry of the apex of a spacer portion 11 of a carrier into the channel portion 10 of the carrier thereabove.

Figure 2:
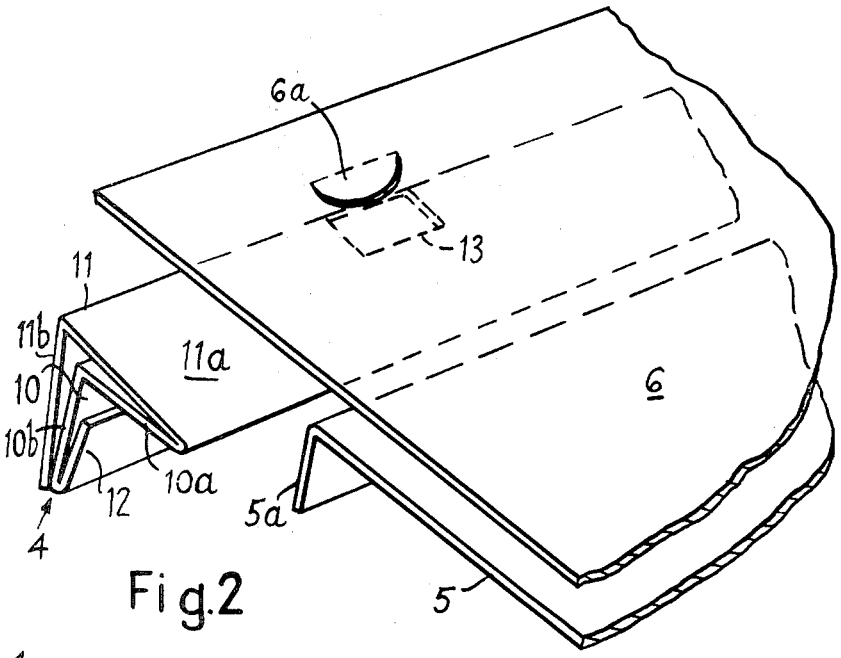
FIG. 2 is an exploded perspective view of one embodiment of carrier and two records for attachment thereto.

It will be understood that various modifications may be made without departing from the scope of the invention. For example, instead of openings 13 and tongues 6*a* as illustrated in FIG. 2, the spacer portion may be provided with studs or other means cooperating with complementary attachment means on the records. Or the records may, as shown at 6' in FIG. 3, simply have a folded over upper end, similar to 5*a* of the record 5, which is hooked over the apex of the spacer portion 11. While such a record can easily be detached when its carrier is moved away from the carrier thereabove, for example to the position of the carrier 4*a* shown in FIG. 1, when the carrier with the record 6' hooked thereon is moved upwards into the channel of the adjacent carrier thereabove, detachment of the record will be inhibited.

To maintain a record which is hooked over the apex of the spacer portion of the carrier in a generally central position on the carrier, the latter may have stops 15 cut out of the wall 11*a* at opposite ends of the apex of the spacer portion, which stops project above the apex as shown in FIG. 5 when the folding of the carrier is completed.

In an alternative embodiment of carrier as shown in FIG. 6, the spacer portion 11 which extends above the channel portion comprises extensions 10*a'* and 10*b'* of the walls 10*a*, 10*b* which are secured together, for example by adhesive. The spacer portion may be provided with slots or other means for attaching a record.

In an alternative embodiment shown in FIG. 7, the upper end of the wall 11*a* of the spacer portion 11 is formed with a flange 16 which, as shown in FIG. 8, can be interengaged with the flange 12 of the channel portion 10 of the carrier thereabove, thereby inter-linking successive carriers in the desired spaced relation. Records, such as 5, may be hooked over the flanges 12, or such as 6' over the tops of the spacer portions (FIG. 9), to provide an overlapping array. Successive carriers can be interengaged by sideways sliding movement. In this embodiment, a panel is not necessary for retaining the overlapping records in assembled array although, of course, the carriers may additionally be assembled in a panel if so desired. In FIGS. 8 and 9 the V-shaped channel portions are shown in a somewhat open position for clarity; in practice the V-shaped channels would be more compressed.

Figure 11:
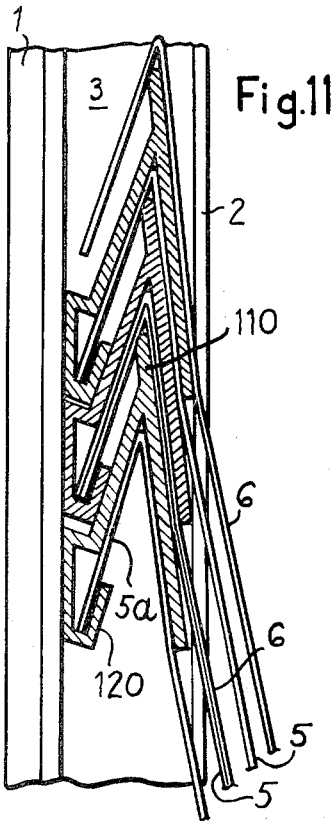
FIG. 11 is a side section showing how the carriers of FIG. 10 are assembled in a panel.
Figure 10:
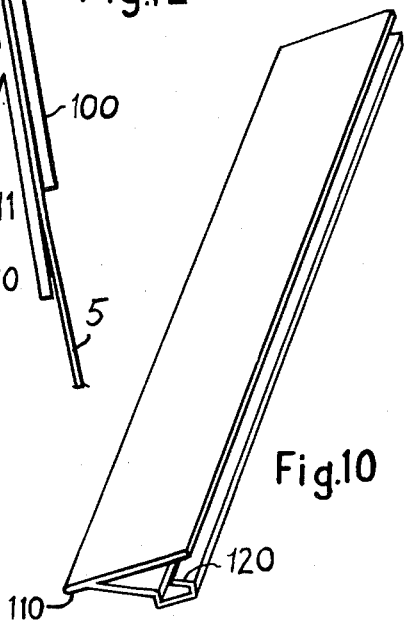
FIG. 10 is a perspective view of a carrier extruded of a plastics material.

The embodiment of the carrier shown in FIGS. 10 and 11 is fabricated by extruding a plastics material, such as PVC or polystyrene. It is extruded with the cross section shown and can, for normal purposes, have a wall thickness of the order of 0.5 mm. It comprises the channel portion 100 with an inwardly projecting flange 120 and a spacer portion 110 projecting above the channel portion. The record 5 is shown as folded from a sheet so that the folded over edge 5*a* rests in the retaining flange 120. The fold is preferably such that the bend extends well up into the channel to prevent disconnection from the retaining flange, whereby withdrawal is normally inhibited by the width of the folded over portion 5*a*. When the carriers are assembled together in a panel, removal of the records is additionally inhibited by the record being pressed between the inner surface of the channel portion of the carrier on which it is hooked and the outer surface of the carrier therebeneath.

Further records 6 may be hooked over the top of a spacer portion 110 to be retained in position by the internesting of adjacent carriers.

In all embodiments where the carriers are assembled in a panel, means ae provided for releasably holding the lowermost carrier in the position in which all the carriers thereabove are internested. This may be effected by a member slidable in the channels 3 in the lower part of the panel 1 and provided with means for securing it in position.

Figure 12:
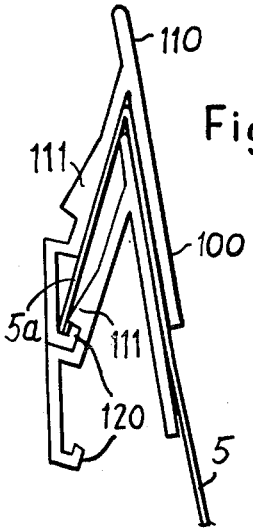
FIG. 12 is a view of a visible index assembled from a modified carrier extruded of plastics material, which is adapted to function without having to be assembled in a panel or tray.

In the embodiment shown in FIG. 12, the carrier 100 is again extruded of a plastics material with a modified cross section which enables the successive carriers to be interengaged so that they can be held together in the nested position without the necessity of assembling the carriers in a panel. This is achieved by extruding the channel section 100 with a generally saw-tooth-shaped rib 111 which is adapted to interengage with a snap-action, or by sideways sliding movement, against the free edge of the retaining flange 120 of the carrier thereabove, the flange 120, in this case, being made of shorter length than in the embodiment of FIGS. 10 and 11. Adjacent carriers may be separated by flexing together the walls of the channel portion 100 of the lower carrier, or by sideways sliding movement.

For resisting normal detachment of a record 5, it is important in this case that the fold 5*a* should extend almost to the top of the channel, internesting of the carriers further inhibiting removal of the record by it being hooked over the top of the spacer portion of the carrier therebeneath and being pressed by the outside surface of the carrier therebeneath against the inside surface of the channel portion of the carrier on to which it is hooked.

The records may be constructed with pockets or other means in or to which microfilm or other information may be stored or attached.

I claim:

1. A visible index comprising a plurality of carriers each comprising an elongate substantially V-shaped channel portion having an apex, a record retaining flange extending inwardly towards the apex of the channel, and a spacer portion which projects beyond the apex of the channel, each said carrier being dimensioned to internest in the channel portion of an identical carrier, in combination with a plurality of records each having an upper edge portion folded over to provide a hook portion which is hooked on to the retaining flange of a respective carrier, the carriers being arranged one above the other in internested relationship so that the records hooked thereon are arranged in overlapping array and are further inhibited from detachment from a retaining flange by the records being between the inner surface of the channel to which it is attached and the outer surface of the carrier therebeneath.

2. A device according to claim 1, and including at least one further record hooked over the top of the spacer portion of a carrier, separation of the further record from the carrier being inhibited by locating said spacer portion with said further record hooked thereover in the channel portion of the adjacent carrier thereabove.

3. A device according to claim 1, wherein said spacer portion comprises means for attaching thereto a record so as to overlie the exterior of said spacer portion and such that location of said spacer portion in the channel portion of a similar carrier positioned thereabove inhibits separation from the carrier of any record attached to its said attaching means.

4. A device according to claim 1, wherein the spacer portion is provided at its extremity with a return flange adapted to be interengaged in the retaining flange of the carrier thereabove.

5. A device according to claim 1, wherein each carrier comprises a plastics extrusion with a cross section comprising a substantially V-shaped channel portion with its retaining flange extending inwardly along the edge of one of the walls of the channel portion, and its spacer portion projecting above the apex of the channel portion, the outer surface of said one wall being formed with a rib positioned to interengage with the free edge of the retaining flange of the carrier thereabove in which it is internested, and interengagement resisting separation of interengaged carriers in the direction transverse to carrier length.

6. A carrier for a record of a visible index comprising an elongate member having a cross section comprising a substantially V-shaped channel portion, an inwardly extending retaining flange along the edge of one of the walls of the channel portion, and a rib extending along the outer surface of said one wall and positioned to interengage with the free edge of the retaining flange of an identical carrier when internested in the channel portion thereof, such interengagement resisting separation of interengaged carriers in the direction transverse to carrier length.

* * * * *